US006877978B2

(12) United States Patent
Sirignano et al.

(10) Patent No.: US 6,877,978 B2
(45) Date of Patent: Apr. 12, 2005

(54) MINIATURE, LIQUID-FUELED COMBUSTION CHAMBER

(75) Inventors: William A. Sirignano, Irvine, CA (US); Derek Dunn-Rankin, Irvine, CA (US)

(73) Assignee: The Regents of the University of California, Oakland, CA (US)

( * ) Notice: Subject to any disclaimer, the term of this patent is extended or adjusted under 35 U.S.C. 154(b) by 305 days.

(21) Appl. No.: 10/140,316

(22) Filed: May 6, 2002

(65) Prior Publication Data

US 2002/0187447 A1 Dec. 12, 2002

Related U.S. Application Data

(60) Provisional application No. 60/296,629, filed on Jun. 6, 2001.

(51) Int. Cl.[7] ..... F23C 3/00
(52) U.S. Cl. ..... 431/4; 431/353; 431/9
(58) Field of Search ..... 431/2, 4, 8, 326, 431/350, 353, 9; 60/39.55, 737, 738, 743

(56) References Cited

U.S. PATENT DOCUMENTS 2,918,118 A * 12/1959 Shirmer ..... 60/743
3,078,672 A * 2/1963 Meurer ..... 60/743
3,691,762 A * 9/1972 Ryberg et al. ..... 60/743
3,955,361 A * 5/1976 Schirmer et al. ..... 60/743
4,604,988 A * 8/1986 Rao ..... 431/4
5,055,030 A * 10/1991 Schirmer ..... 431/353
5,069,033 A * 12/1991 Shekleton ..... 60/737
5,281,132 A * 1/1994 Wymaster ..... 431/353

* cited by examiner

*Primary Examiner*—Sara Clarke
(74) *Attorney, Agent, or Firm*—Orrick, Herrington & Sutcliffe LLP

(57) ABSTRACT

A miniature combustor comprising a combustion chamber having at least one critical dimension that is sub-centimeter. Combustion is confined within the chamber by injecting a liquid fuel as a film over substantially the entire area of the chamber walls. In a preferred embodiment, a swirl or vortex generator may be included at the entrance of the chamber to cause the in-flowing oxidizing gases to swirl within the chamber. The liquid fuel may be applied as a film through one or more orifices or a porous wall material, or may be applied by spraying the fuel on a surface within the chamber. The liquid fuel may be augmented with an inert liquid such as water.

16 Claims, 5 Drawing Sheets

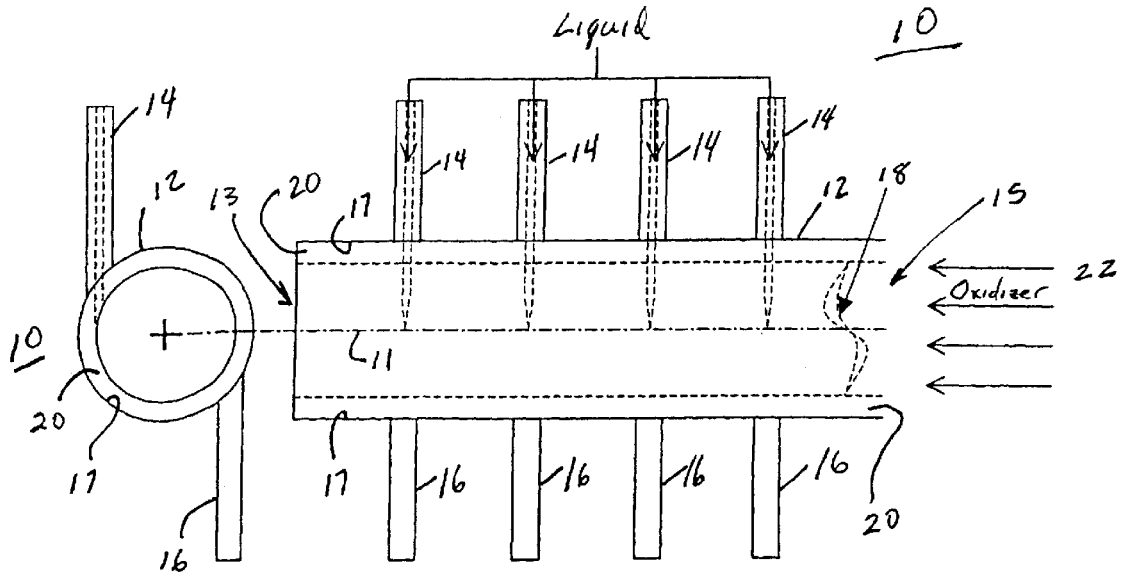
Fig 1A
Fig. 1
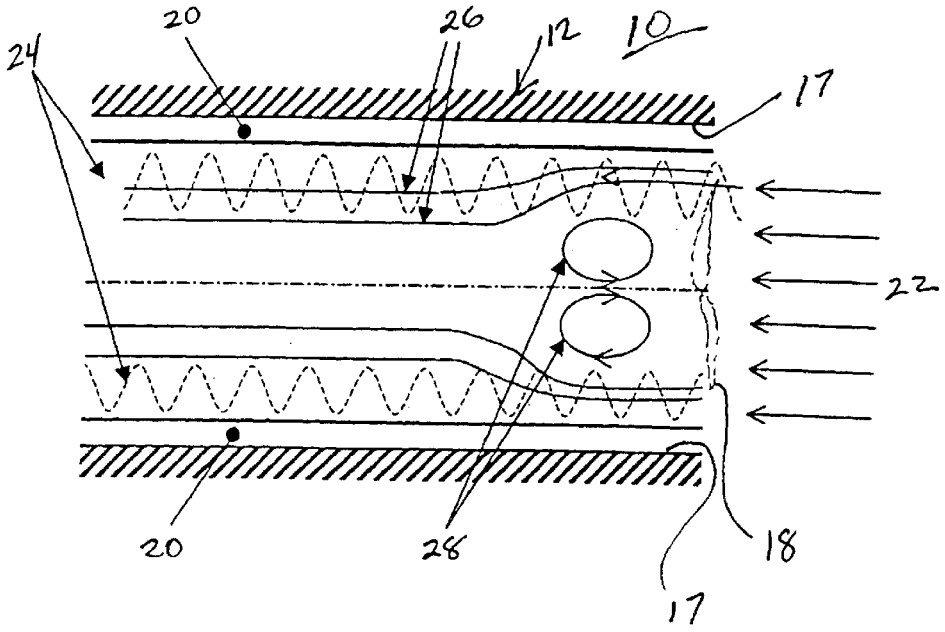
Fig. 2

318

MINIATURE, LIQUID-FUELED COMBUSTION CHAMBER

This application claims priority from U.S. Provisional Patent Application Ser. No. 60/296,629 filed Jun. 6, 2001.

FIELD OF THE INVENTION

The invention relates to combustion systems and methods and, more particularly, to combustion within a miniature combustion chamber using a liquid fuel.

BACKGROUND OF THE INVENTION

The growing market of ideas that require personal power ranges from electronic and telecommunication equipment (e.g., cellular telephones and laptop computers) to small, mobile reconnaissance robots that can safety explore potentially hazardous environments. Many of these lightweight devices demand tens of Watts of power for durations on the order of tens of hours, thereby driving power source considerations toward those power sources with the highest energy density.

The energy density of burning hydrocarbon fuels is difficult to surpass when an oxidizer stream is plentiful, as with combustion in ambient air. Assuming no energy cost for the oxidizer, for example, typical hydrocarbon fuels can provide a power density of 45 MJ/kg, while a modern rechargeable battery can only manage a mere 0.5 MJ/kg. Even fuel cells, while highly touted for their efficiency and simplicity, only provide power densities comparable to batteries, i.e., 0.7 MK/kg. Perhaps more importantly, the energy per unit volume of electrochemical devices is quite low because they rely on surface reactions, while combustion is a volumetric energy release process. Consequently, if the ultimate goal of a power device is propulsive or heating, direct combustion will have clear advantages. Even when electrical power is desired, where the combustor dimensions are often a small fraction of the volume occupied by the conversion hardware, if high power density is needed, combustion technology tends to still hold clear advantages.

Because internal combustion has the potential to simultaneously provide high power density and high energy density, many researchers have attempted to explore it as a method for power generation on a miniature scale. Examples of such exploration include, a micro-gas turbine with a combustor volume of 0.04 cubic centimeters (see Waitz et al., 120 Jnl. Fluids Engr., 109–117 (1998)), a mini (0.078 cc displacement) and a micro (0.0017 cc displacement) rotary engine (see Fu et al., 99F023 Combustion Inst., Western States Sect., Fall Mtg. (1999)), a microrocket with a 0.1 cubic centimeter combustion chamber (see Lindsay et al., IEEE Cat. No. 01CH37090, 606-610 (2001)), and a micro Swiss roll burner (see Sitzki et al., 3rd A-P Conf. Combustion (2001)). Although these devices have demonstrated the plausibility of internal combustion as a personal power source, they are not able to perform at efficiencies that make them competitive with the best available batteries.

A major challenge for all miniature combustion concepts is the increasing surface-to-volume ratio (S/V) with decreasing combustor size (since this ratio scales as the inverse of the combustor length scale), where the volume is the combustor volume and the surface is the area of the wall surface that bounds the combustor volume. Because wall temperatures are generally kept fairly low due to material considerations, a high S/V ratio results in high heat transfer losses and, thus, usually produces flame quenching, particularly for premixed flames. Attempting to overcome such problems, researchers have turned to quench-resistant fuels such as hydrogen gas, combustion chambers with catalytic surfaces, or high-preheat concepts such as the Swiss roll burner (Sitzki et al.).

Thus, it is desirable to provide an efficient miniature combustor capable of burning typical hydrocarbon fuels while avoiding quenching.

SUMMARY OF THE INVENTION

The present invention is directed to an apparatus and method that facilitates sustaining a flame and, thus, confining combustion of typical hydrocarbon fuels within a combustion chamber of a miniature combustor while avoiding quenching. In one innovative aspect of the present invention, the miniature combustor comprises a combustion chamber with at least one critical dimension that is sub-centimeter and, preferably, a combustion chamber with a lateral dimension transverse to the major flow direction that is as small as about 1 to 3 millimeters. Such dimensions are comparable to known quenching distances wherein the surface-to-volume ratio for the combustion chamber is so large that a flame is typically not sustainable within the chamber due to the large heat transfer losses to the chamber walls. However, in another innovative aspect of the present invention, liquid fuel is injected as a film that tends to cover the entire or substantially the entire area of the chamber walls. With a liquid fuel applied to and maintained on the chamber walls, the heat transferred from hot combustion gases will be captured by the liquid fuel protecting the walls, thus enabling a flame to be sustained within the chamber. In addition, the heat transferred from the hot combustion gases serves to aid in the vaporization of the liquid fuel so it is burned before it exits the chamber.

In yet another innovative aspect of the present invention, the liquid fuel may be augmented with an inert liquid, such as water, if there is not sufficient liquid fuel to cover the area of the walls of the combustion chamber. In instances when a non-liquid or gaseous fuel is being utilized and combustion heat loss to the walls of the chamber is problematic, combustion may be augmented by filming a liquid, fuel or inert, or a combination of both, on the walls of the combustion chamber.

In a preferred embodiment, the miniature combustor of the present invention includes a sub-centimeter sized combustion chamber, preferably with a diameter in a range of about 1 to 3 millimeters, and a length preferably in a range of about 1 to 10 centimeters. A series of liquid fuel injectors are attached tangentially and orthogonally to the chamber to inject liquid fuel as a film tangentially over the wall of the chamber. Filming of the liquid fuel on the inner surfaces of the chamber wall, however, may alternatively be accomplished by spraying the fuel onto a chosen surface within the chamber so as to avoid rebound and substantial vaporization before striking the surface, or may be injected through a single orifice or through porous materials to flow tangentially along the inner surface of the chamber wall.

In operation, liquid fuel is injected into the interior of the combustion chamber under a pressure sufficient to cause the fuel to film tangentially over the inner surface of the chamber wall. Simultaneously, oxidizing gases are injected into the combustion chamber through a swirl or vortex generator, causing the gases to swirl about the interior of the chamber. An ignition device positioned within the chamber ignites a flame and, thus, initiates combustion within the chamber. The flame propagates along the streamlines of in-flowing oxidizing gases along the wall of the chamber adjacent the liquid film. Heat from the combustion is captured by the fuel layer, preventing heat transfer losses to the chamber wall and, thus, quenching of the flame. As a result, combustion is confined to the interior of the chamber.

Further, objects and advantages of the present invention will become apparent from the following detailed description and accompanying drawings.

BRIEF DESCRIPTION OF THE DRAWINGS

FIG. 1 is a diagrammatic view of a miniature combustor of the present invention.

FIG. 1A is an end view of the miniature combustor shown in FIG. 1.

FIG. 2 is a diagrammatic view of the miniature combustor shown in FIG. 1 in operation.

DETAILED DESCRIPTION OF THE PREFERRED EMBODIMENT

Figure 3:
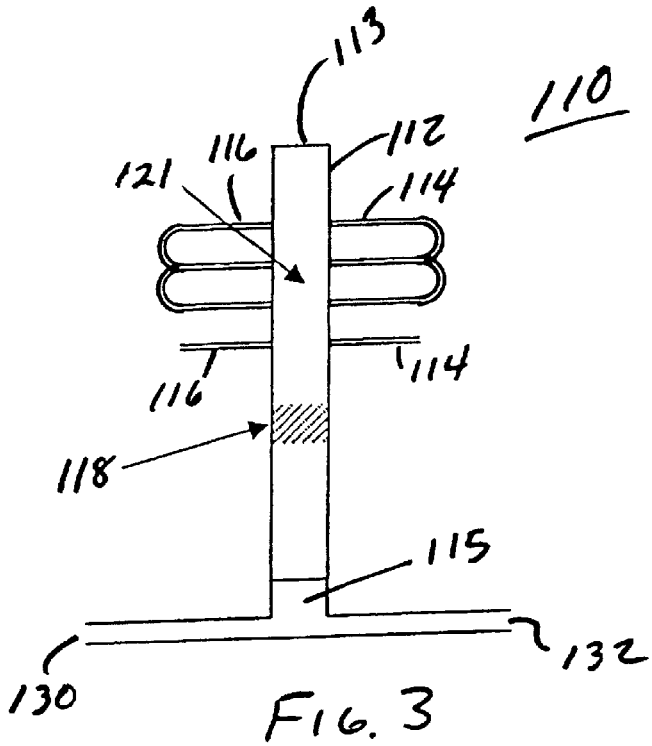
FIG. 3 is a diagrammatic view of a miniature combustor system employed in experiments utilizing the methodology of the present invention.

The present invention is directed to an improved method and apparatus for sustaining a flame and, thus, confining combustion to the interior of a combustion chamber of a miniature combustor. A miniature combustor is defined herein as one in which the combustion chamber has at least one critical dimension that is sub-centimeter. Preferably, the miniature combustion chamber of the present invention has a lateral dimension transverse to the major flow direction that is as small as about 1 to 3 millimeters. At these dimensions, which are comparable to known quenching distances, the surface-to-volume ratio for the combustion chamber is so large that a flame is typically not sustainable within the chamber due to the large heat transfer losses to the chamber walls. However, by injecting a liquid, fuel or inert, as a film that covers the entire or substantially the entire area of the chamber walls, the combustion chamber is capable of maintaining a flame and eliminating quenching. With a liquid film applied to and maintained on the chamber walls, the heat transferred from hot combustion gases will be captured by the liquid protecting the walls. When the liquid is a fuel, the heat transferred from the hot combustion gases will serve to aid in vaporization of the liquid fuel so it is burned before it exits the chamber.

Current technology for larger systems does not rely on liquid fuel filming on the chamber walls (though some fuel is intentionally vaporized from intake manifolds in IC engines as part of the charge preparation). Instead, to keep the ratio of liquid surface area to liquid volume large enough to sustain high fuel vaporization rates, the fuel is injected as a spray. The intention is to vaporize the liquid as a spray before very much liquid deposits on the walls or solid surfaces of the chamber. If the fuel were filmed in these larger engines, the surface area of the liquid would not be large enough to sustain the needed vaporization rate. Because the S/V ratio of any wall film will grow as the volume of the combustor decreases, the liquid fuel film in combustors in the sub-centimeter size range tends to provide a liquid surface area for vaporization comparable to a vaporizing spray. Furthermore, the liquid fuel film protects against heat losses at the wall and, thus, quenching, that a vaporizing spray does not. With the liquid film on the solid surfaces of the combustor, the wall temperatures of the combustor tend not to exceed the boiling point of the liquid.

In cases where not enough liquid fuel is available to cover the critical surfaces of the combustion chamber with a fuel film, inert (non-combusting) liquids, such as water, can be used to augment the liquid fuel. Furthermore, when non-liquid or gaseous fuels are the combustion fuel, combustion within a miniature combustor may be aided by filming liquid fuel and, in some cases, inert liquids on the internal solid surfaces of the combustion chamber.

The liquid, fuel or inert, may be applied as a film by several means. For example, the liquid fuel may be sprayed onto a chosen surface within the chamber so as to avoid both rebound and substantial vaporization before striking the surface. The liquid fuel may also be injected through an orifice, multiple orifices, or porous materials forming all or at least a portion of the chamber wall, to flow tangentially along the surface of the combustion chamber. The liquid fuel tends to be spread over the surface of the chamber as a result of its own momentum and surface tension, the friction forces caused by neighboring flowing gases, and/or the intended use of certain force fields, e.g., an electric field on charged liquid or gravity.

Swirl or vortex generators, positioned at the inlet of the combustion chamber, may be used to swirl in-flowing oxidizing gases to enhance vaporization and mixing rates and, thus, combustion at high flow rates. In addition, swirling of the liquid as it is injected into the film tends to stabilize the liquid film, due to centrifugal effects, on the surface of the chamber walls.

Turning to FIGS. 1 and 1A, a diagrammatic representation of a miniature combustor 10 of the present invention is provided. As depicted, the combustor 10 includes a combustion chamber 12 that is generally cylindrical in shape. However, those of skill in the art will recognize that the film combustion methodology of the present invention will extend to many other combustion chamber shapes and configurations. The chamber 12 preferably has a sub-centimeter sized diameter and, most preferably, a diameter in a range of about 1 to 3 millimeters, and a length preferably in a range of about 1 to 10 centimeters. The chamber 12 is preferably formed from materials know in the art such as steel, stainless steel, composites, and the like. The chamber wall 17 may be solid or porous.

A series of liquid fuel injectors 14 and 16 are attached to the chamber 12 and include orifices opening into the interior space of the chamber 12 defined by the chamber wall 17. Preferably, the injectors 14 and 16 are oriented orthogonally relative to a longitudinal axis 11 of the chamber 12. In addition, the injectors 14 and 16 are preferably attached tangentially to the wall 17 of the chamber 12 to aid in the filming of the fuel tangentially over the inner surface of the chamber wall 17. Although the first and second sets of fuel injectors 14 and 16, as depicted in the illustrated embodiment, are symmetrically opposed about the chamber 12, those of skill in the art will recognize that the fuel injectors 14 and 16 may be randomly positioned about the circumference of the chamber 12 in any orientation enabling the liquid fuel to be injected as a film over the inner surface of the chamber wall 17.

As indicated above, filming of the liquid fuel on the inner surfaces of the wall 17 of the combustor may alternatively be accomplished by spraying the fuel onto a chosen surface within the chamber 12 so as to avoid rebound and substantial vaporization before striking the surface. Additionally, the liquid fuel may be injected through a single orifice or through porous materials to flow tangentially along the inner surface of the wall 17.

The chamber 12 of the combustor 10 includes an entrance or inlet opening 15 through which oxidizing gases flow and an exit opening 13 through which hot combustion product gases exit the chamber 12. The oxidizing gases may comprise ambient air, oxygen-enriched air, pure oxygen, fluorine, and the like. The combustor 10 also preferably comprises a swirl or vortex generator 18 positioned within the combustor 10 adjacent the entrance opening 15 of the chamber 12 in the path of the inflowing oxidizing gases.

In operation, as depicted in FIG. 2, liquid fuel is injected into the interior of the combustion chamber 12 through the injectors 14 and 16 under a pressure that is sufficient to cause the fuel to bleed out of the orifices of the injectors and film tangentially over the inner surface of the chamber wall 17. Simultaneously, oxidizing gases are injected into the combustor 10 through the inlet opening 15. As the oxidizing gases pass through the swirl or vortex generator 18 they are caused to swirl about the interior of the chamber 12. As is well known, if the swirl is strong enough, a recirculation flow 28 may occur that assists combustion within the chamber by increasing the flow residence time and thereby benefiting flame holding and flame stability.

An ignition device (not shown) positioned within the interior of the chamber 12, preferably adjacent the swirl generator 18, is activated to ignite a flame and, thus, initiate combustion within the chamber 12. As depicted, a flame 24 tends to propagate across the streamlines 26 of the in-flowing oxidizing gases and downstream along the wall 17 of the chamber 12 adjacent to the liquid film 20. The general region where the flame will exist is indicated in FIG. 2 by the wavy dashed line. The wavy line is not intended to imply that the flame will necessarily have a wavy shape. Heat from the combustion of the oxidizer-fuel mixture is captured by the fuel layer 20, preventing heat transfer losses to the wall 17 of the chamber 12 and, thus, quenching of the flame 24. As a result, combustion is confined to the interior of the chamber 12.

Depending on the physical dimensions of the combustor 10 and the operating parameters such as air flow, fuel type, combustion pressures, and liquid filming flow rates, the power produced by a system incorporating a miniature combustor 10 of the present invention could be between 10 W and 10 kW, even assuming an overall engine efficiency of 20 to 30%. For example, with a range of parameters that includes combustors with diameters in the range of about a few millimeters to one centimeter, kerosene and alcohol fuels, inlet airflow velocities of up to about ten meters per second (and thereby air volume flow rates up to about one thousand cubic centimeters per second), combustor pressures up to about ten atmospheres, and filming liquid flow rates maintained at or near stoichiometric proportion, calculations indicate that the vaporization rate and the gaseous mixing rate can be high enough to sustain the combustion and that a combustor no longer than a few centimeters, i.e., 3 to 4 centimeters, can provide sufficient residence time to fully burn the fuel. Although the film thickness tends to be on the order of tens of microns, the Reynolds number tends to be larger than unity, indicating that viscous forces do not prevent the movement of liquid along the solid surface.

For more specific parameters, the findings are as follows. The ratio of air mass flow rate to the fuel mass flow rate at stoichiometric proportion is about O(10) for typical liquid hydrocarbon fuels. For example, the ratio is 14.7 for $C_nH_{2n}$, 15.1 for heptane, and 6.4 for methyl alcohol. A tube of internal diameter between about 5 and 10 mm and an axial air velocity $u_g$ of about 1 to 10 m/sec will produce an air volumetric flow rate $V_g$ of about 0.025 to 1.0 liter/sec. The density ratio of liquid fuel to air tends to vary from about $O(10^3)$ at atmospheric pressure to $O(10^2)$ at ten atmospheres. With stoichiometric proportions, the volumetric flow rate ratio (air to liquid) tends to be between about $O(10^3)$ and $O(10^4)$. The liquid volume flow rate $V_l$ then has a value between about $O(10^{-3})$ and O(1) cc/sec. With a liquid density $\rho_l$ of about O(1 gm/cc), this implies a flow from about one milligram of fuel per second (for d=5 mm; $u_g$=1 m/s; $\rho$=1 atm) to about one gram per second (for d=10 mm; $u_g$=10 m/s; $\rho$=10 atm). The power range for these fuel flow rates can be significant; chemical energy release rates with typical hydrocarbon fuels will vary between about 10 and $10^4$ calories per second. As noted above, even with a poor overall engine efficiency of 20 to 30%, the power produced by a system that includes a miniature combustor of the present invention would be between 10 W and 10 kW for the range of parameters considered above.

Because of their small size, small weight, and mobility, the miniature combustors of the present invention have many potential applications. As indicated above, a combustor with an overall lateral (transverse to major flow direction) dimension of a few millimeters can produce more than a kilowatt of energy when the combustor is incorporated into an engine of proportional dimensions. Accordingly, the miniature combustors and associated combustion methodology of the present invention may be applied to rockets, ramjets, turbojets, internal combustion engines (reciprocating or rotary), heating furnaces, kilns, boilers or hot water heaters, and to any other combustor when heat losses to chamber walls must be reduced and/or quenching must be prevented. In addition, because of its size, the miniature combustor of the present invention lends itself for use as part of distributed power sources utilized in large power systems, such as a power system for an aircraft, an office building, a manufacturing facility, and the like.

Referring to FIG. 3, a schematic is provided of an apparatus used to conduct experiments using the combustion methodology of the present invention. As depicted, the combustor 110 includes a combustion tube 112 approximately 1 cm in diameter and 4 cm long. Eight 1-mm-diameter inlet tubes 114 and 116 are attached, offset from the centerline, to the combustion tube 112 and a liquid fuel syringe pump (not shown) is attached to the inlet tubes. A swirler 118 adjacent to the base 115 of the tube 112 included a simple sheet metal butterfly. In operation, the swirling airflow tended to distribute the film along the interior surfaces. The system included opposing inlets 130 and 132 for air and methane introduction to allow gas combustion comparisons, to assist ignition of the liquid fuel, and to increase stability under some operating conditions.

Figure 4:
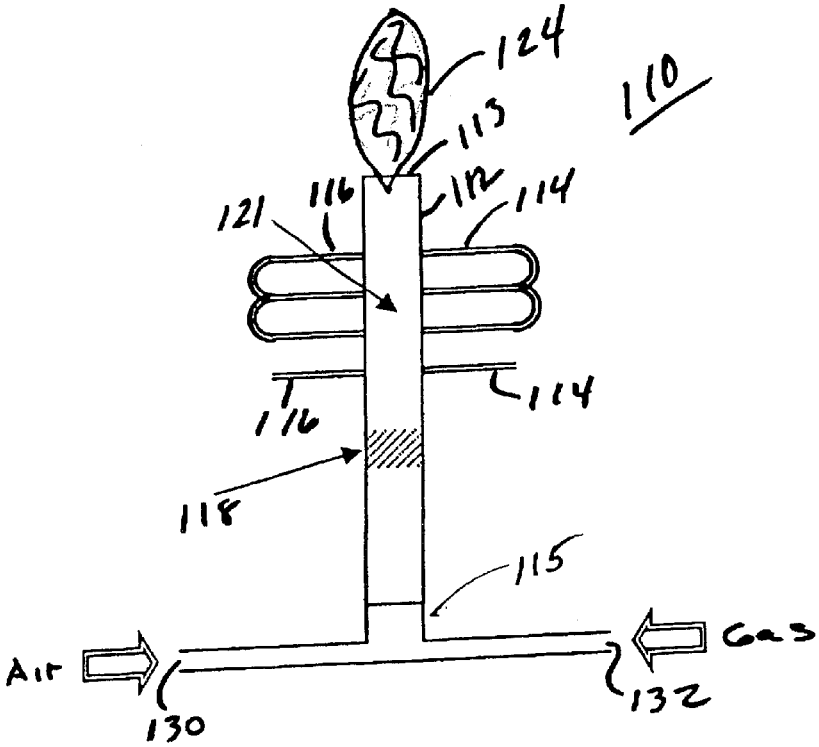
FIG. 4 illustrates combustion of only a gaseous mixture of fuel and air injected into the miniature combustor system shown in FIG. 3.

Gas fuel only—The first experiments employed premixed gaseous fuel and air only, no liquid. The resulting behavior is shown diagrammatically in FIG. 4. As depicted, a methane flame 124 formed above the tube exit 113, with the tip of the flame 124 slightly below the end 113 of the combustor tube 112. The flame 124 is not attached to the rim of the tube 112 and appears to be swirl stabilized in much the same way as occurs in the low-swirl burners. That is, as the confined swirling flow exits the tube, the flame finds a balance between the decelerating expanding flow (from the centrifugal motion) and the flame speed.

Figure 8:
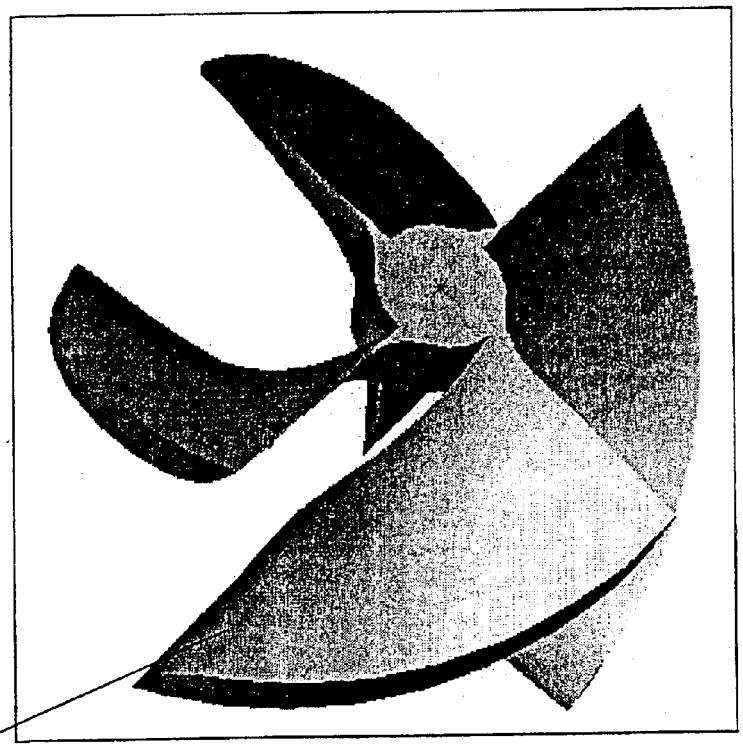
FIG. 8 is a perspective view of an exemplary swirler used in preferred embodiments of the miniature combustor of the present invention.

Internal burning of the gaseous fuel and air mixture was accomplished by increasing the swirl magnitude using a swirl-vane design that enables symmetric swirl. See, for example, swirler 318 shown in FIG. 8. Enhanced swirl provided by tangential injection of the air (without a mechanical swirler) also produced an internally burning flame. This demonstrates that a gaseous internal flame requires greater swirl and recirculation. Furthermore, when the gas-only flame burned internally, there were substantial heat losses to the wall, indicating that quenching would likely occur for diameters much smaller than 1 cm.

Figure 5:
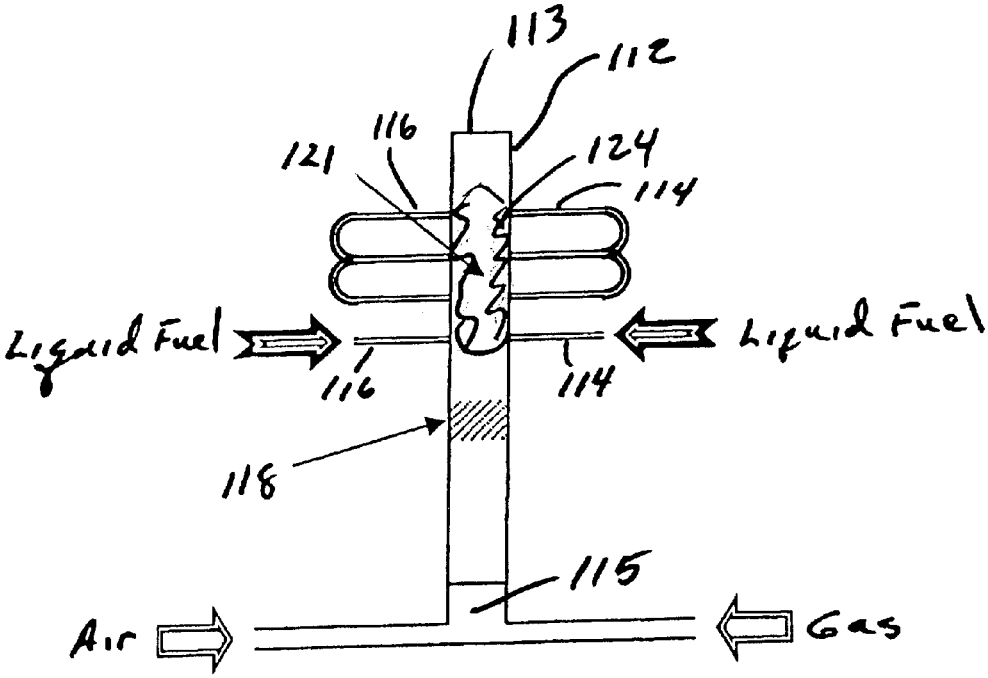
FIG. 5 illustrates combustion of a mixture of gaseous fuel, air and liquid fuel in the miniature combustor system shown in FIG. 3 with the liquid fuel applied as a film to the chamber walls.

Gas and liquid fuel—In the next experiments, both gas and liquid fuels were used simultaneously. To ignite the flame, a bit of liquid fuel was fed into the base 115 of the combustion tube 112. The fuel/air mixture was then flowed into the combustion tube 112 and the flame was ignited at the exit 113 of the tube 112. The flow rates were 8 liters per minute for air, 0.25 liters per minute for methane, and 25 cc per hour for methane. The flame was fed by both some liquid picked up as the air flowed past the pool at the base of the combustor and by the gas. When the gas fuel flow rate was decreased, the flame 124 jumped into the tube 112, where it burned in a confined state within the combustion area 121, as shown in FIG. 5.

Figure 6:
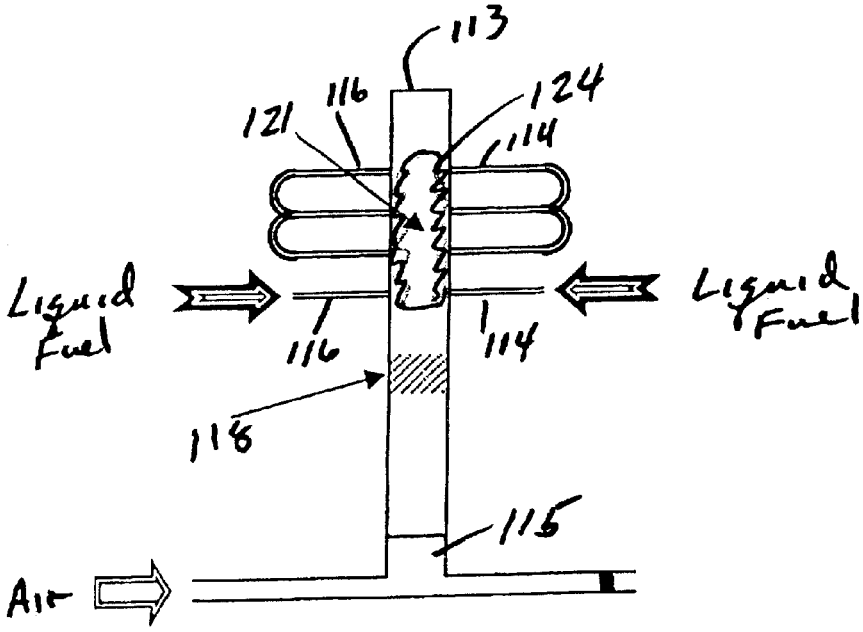
FIG. 6 illustrates combustion of a mixture of only liquid fuel and air in the miniature combustor system shown in FIG. 3 with the liquid applied as a film to the chamber walls.

Liquid fuel only—In the next experiments, only liquid fuel, i.e., liquid heptane, was used. Heptane liquid has a factor of 4 lower heat of vaporization as compared to methanol (heptane—318 kJ/kg; methanol—1100 kJ/kg) making it a more attractive fuel for use with the miniature combustor 110. FIG. 6 shows a pure liquid heptane/air flame 124 burning within the combustion area 121 in the combustion tube 112 of the miniature combustor 110. The flow rates were 8 liters per minute for air and 38 cc per hour for heptane.

One of the challenges to managing swirl mechanically in the combustor of the present invention is that the swirl effects are connected to the overall airflow rate. It is not possible, therefore, to separately control the turndown and swirl of in-flowing air. An alternative or augmentative method for introducing swirl and vorticity to the inflowing air is to inject all or some of the inflowing air perpendicularly to the chamber's main axis and tangentially to the chamber wall through tangentially aligned injectors air, as illustrated in FIGS. 7 and 7A.

Figures 7, 7A:
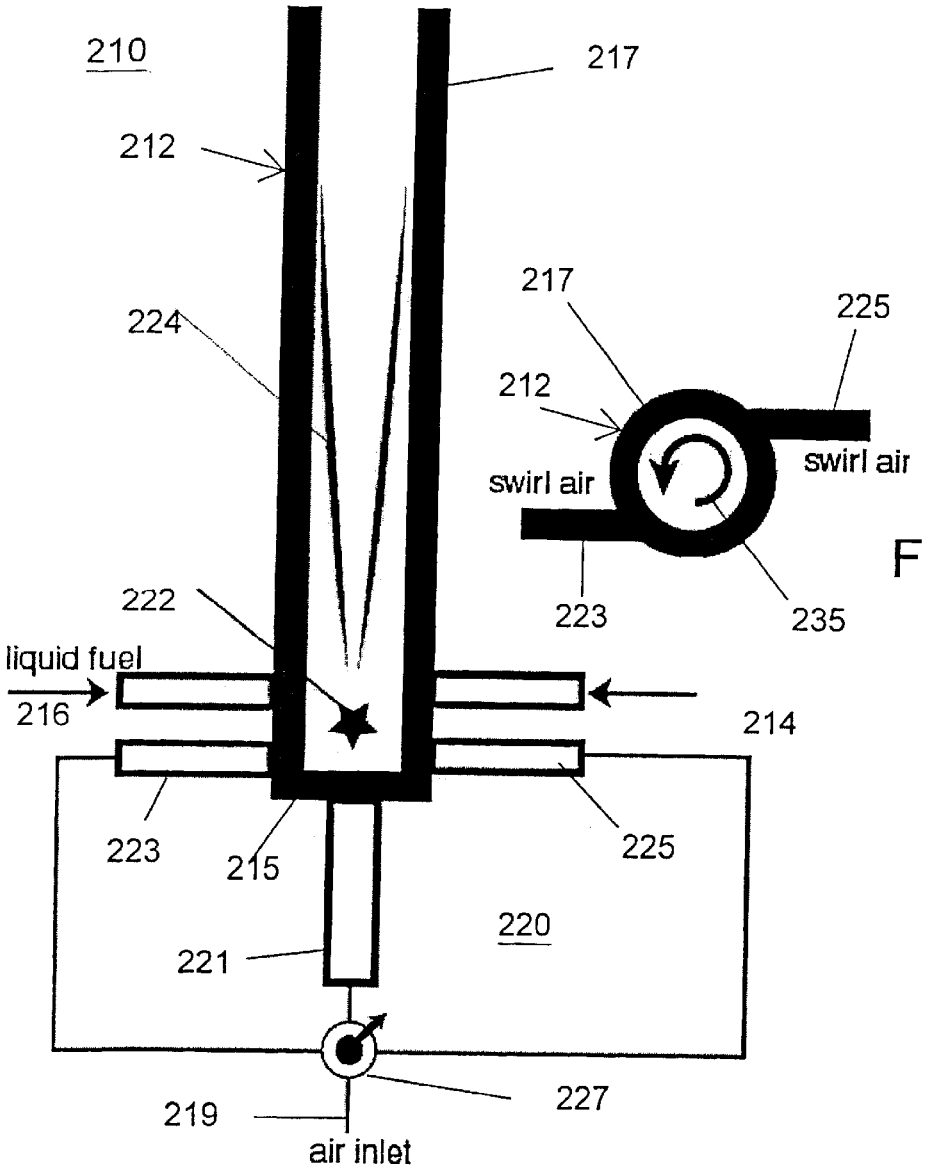
FIG. 7 is a diagrammatic view of an alternative embodiment of a miniature combustor of the present invention.
FIG. 7A is an end view of the miniature combustor shown in FIG. 7.

As depicted in FIGS. 7 and 7A, the alternative embodiment of a combustor 210 of the present invention includes a generally cylindrically shaped combustion chamber 212 defined by a chamber wall 217, liquid fuel injector inlets 214 and 216 tangentially coupled to the chamber wall 217 adjacent to the base 215 of the chamber 212, an igniter 222 positioned within the chamber 212 adjacent to the base 215, and an inlet air flow system 220. The airflow system 220 comprises an axial inlet 221 opening into the base 215 of the chamber 212 to provide axial air flow into the chamber 212 and tangential inlets 223 and 225 tangentially coupled to the chamber wall 217 to provide inflowing air perpendicularly to the chamber's main axis and tangentially to the chamber wall 217 to create swirl 235. The air flow system 220 further comprises an adjustable air flow splitter or controller 227 that controls the flow of air from a main air inlet 219 to the axial 221 and tangential inlets 223 and 225. The splitter 227 may be manually adjustable or may be auto-adjustable via an appropriate control system. Alternatively, the axial inlet 221 and the tangential inlets 223 and 225 may have separate inlet air sources and controls.

While the invention is susceptible to various modifications and alternative forms, a specific example thereof has been shown in the drawings and is herein described in detail. Many alterations and modifications can be made by those having ordinary skill in the art without departing from the inventive concepts contained herein. It should be understood, therefore, that the illustrated embodiment has been set forth only for the purposes of example and that it should not be taken as limiting the invention.

What is claimed is:

1. A miniature combustor comprising:

a chamber having first and second ends, wherein the chamber has a lateral dimension transverse to a major flow direction within the chamber that is sub-centimeter;

a liquid-fuel inlet into the chamber;

a gas inlet formed in a first end of the chamber;

a swirl generator comprising a swirler positioned within the chamber adjacent the first end and a plurality of gas inlets tangentially coupled to the chamber adjacent the first end of the chamber; and an axial gas inlet adjacent the first end of the chamber.

2. The combustor of claim 1 wherein the lateral dimension is in a range of about 1.0 to 3.0 millimeters.

3. The combustor of claim 1 wherein the chamber is generally cylindrical.

4. The combustor of claim 1 wherein the length of the chamber is in a range of about 1.0 to 10.0 centimeters.

5. The combustor of claim 1 wherein the liquid-fuel inlet comprises a fuel injector oriented to eject fuel onto a surface within the chamber.

6. The combustor of claim 1 wherein the liquid-fuel inlet comprises at least a portion of a chamber wall formed of a porous material.

7. The combustor of claim 1 wherein the liquid-fuel inlet comprises a plurality of orifices.

8. The combustor of claim 7, further comprising a plurality of liquid fuel injectors, each coupled to one of the plurality of orifices and oriented tangentially to a wall of the chamber and orthogonally to the major flow direction within the chamber.

9. The combustor of claim 8 wherein the plurality of liquid fuel injectors comprise first and second set of injectors wherein the first and second set of injectors are symmetrically opposed about the chamber.

10. The combustor of claim 1 further comprising an adjustable gas flow splitter coupled to the axial gas inlet and the plurality of tangential gas inlets.

11. A combustion process comprising:

injecting liquid into a combustion chamber, wherein the liquid is a combination of a liquid fuel and an inert liquid;

forming and maintaining a liquid film over substantially an entire interior surface of the chamber;

injecting an oxidizing gas into the chamber;

burning an oxidizing gas and fuel mixture within the chamber.

12. The method of claim 11 further comprising the step of swirling the oxidizing gas.

13. The method of claim 11 wherein the step of forming and maintaining a liquid film over substantially an entire interior surface of the chamber, includes reducing combustion heat losses to walls of the chamber.

14. The method of claim 11 wherein the step of injecting an oxidizing gas includes injecting the oxidizing gas axially into the chamber and swirling the axially in-flowing gas by passing it through a swirl generator positioned adjacent to an inlet of the chamber.

15. A combustion process comprising:

injecting liquid into a combustion chamber;

forming and maintaining a liquid film over substantially an entire interior surface of the chamber;

injecting an oxidizing gas axially into the chamber and injecting the oxidizing gas orthogonally to the axial gas injection and tangentially to walls of the chamber;

burning an oxidizing gas and fuel mixture within the chamber.

16. The method of claim 15 further comprising the step of separately controlling the axial and tangential injection of the oxidizing gas.

* * * * *